United States Patent [19]

Sasaki

[11] 4,104,865

[45] Aug. 8, 1978

[54] ELECTRONIC TIMEPIECE HAVING AN ALARM DEVICE

[75] Inventor: Seikou Sasaki, Matsudo, Japan

[73] Assignee: Kabushiki Kaisha Daini Seikosha, Japan

[21] Appl. No.: 699,360

[22] Filed: Jun. 24, 1976

[30] Foreign Application Priority Data

Jun. 24, 1975 [JP] Japan ..... 50-77847

[51] Int. Cl.[2] ..... G04B 19/24; G04C 21/28; G04B 23/12

[52] U.S. Cl. ..... 58/58; 58/4 A; 58/38 R; 58/57.5; 340/384 E

[58] Field of Search ..... 58/4 A, 13, 16.5, 19 R, 58/21.11, 38, 57.5, 58, 38 R; 340/384 E, 392, 393

[56] References Cited

U.S. PATENT DOCUMENTS

| | | | |
|---|---|---|---|
| 3,664,116 | 5/1972 | Emerson | 58/38 R |
| 3,728,855 | 4/1973 | Preiser | 58/38 R |
| 3,834,153 | 9/1974 | Yoda | 58/38 R |
| 3,940,918 | 3/1976 | Everson | 58/38 R |

*Primary Examiner*—Edith S. Jackmon

*Attorney, Agent, or Firm*—Robert E. Burns; Emmanuel J. Lobato; Bruce L. Adams

[57] ABSTRACT

An electronic timepiece having an alarm device has a plurality of memory channels whereby the alarms can be set for different times. Moreover, the memory circuit for days has a capacity greater than the counting capacity of the "day" counter of the timepiece so that an alarm time can be set for each day. The timepiece has a plurality of alarm signal generating circuits so that a selection of different alarm sounds is provided.

7 Claims, 14 Drawing Figures

FIG. 3
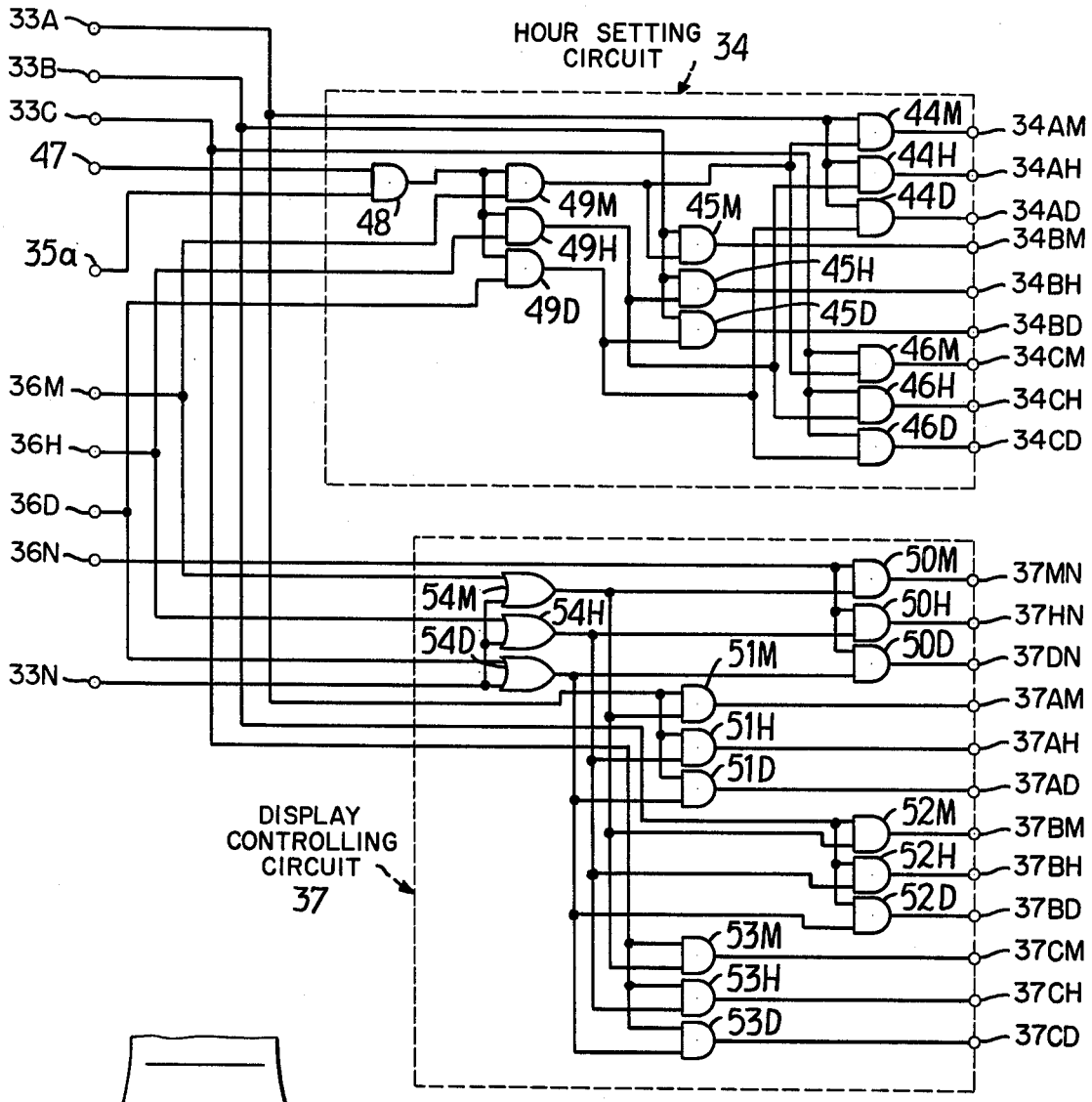
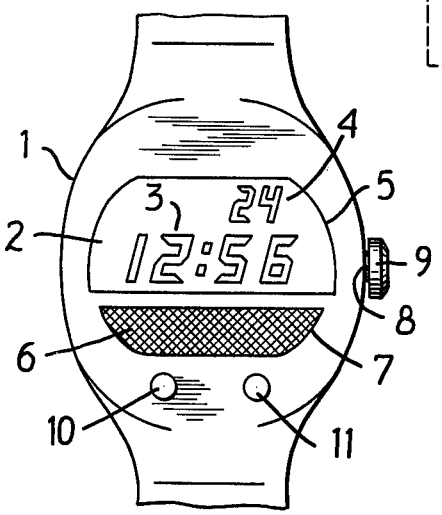
FIG. 1

FIG. 8
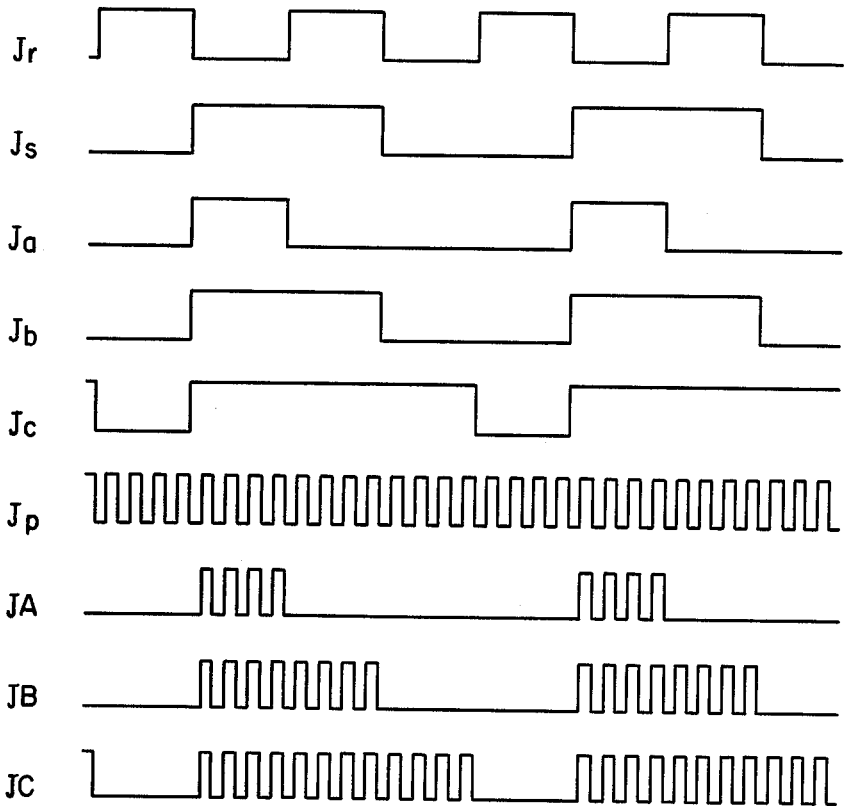
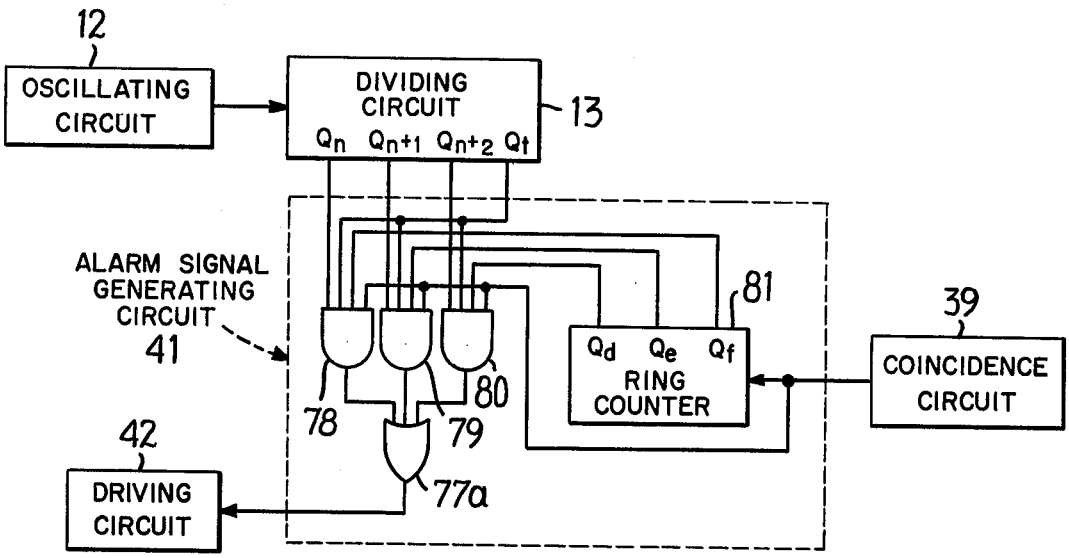
FIG. 9

FIG. 10
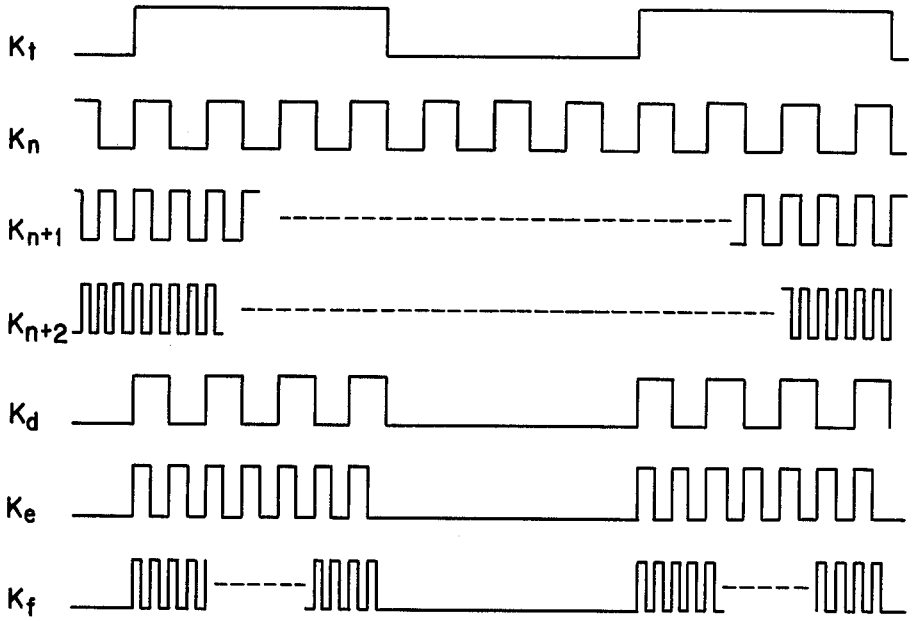
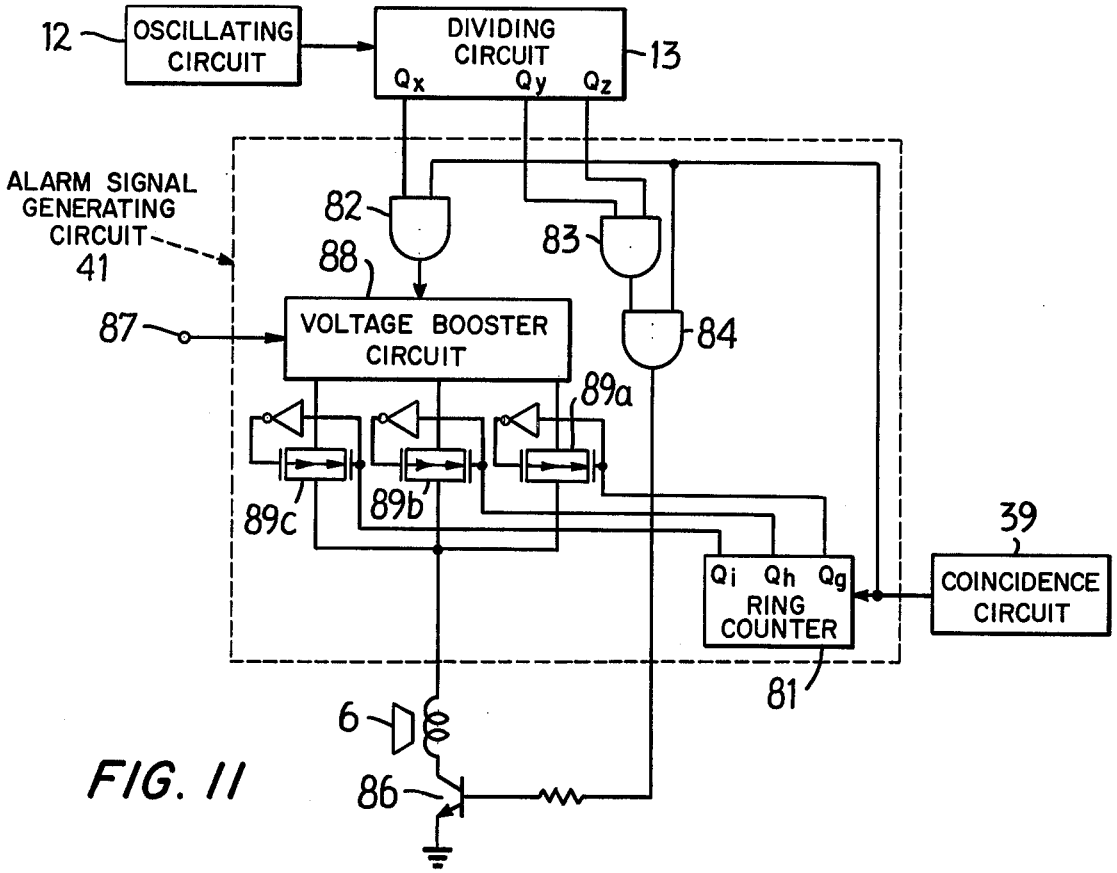
FIG. 11

ELECTRONIC TIMEPIECE HAVING AN ALARM DEVICE

FIELD OF INVENTION

The present invention relates to an electronic timepiece and in particular an electronic watch having an alarm device and a plurality of channels for setting the alarm time for predetermined dates, hours and minutes. Moreover it is possible to set the alarm for a predetermined time without reference to the date. The timepiece further has a plurality of alarm signal generating circuits so that different alarm sounds can be provided for different channels.

BACKGROUND OF INVENTION

A conventional electronic timepiece having an alarm device is provided with one or more channels for setting the alarm time for a predetermined date, hour and minutes. The alarm device is operated when coincidence occurs between the set contents of the alarm channels and the counted contents of the time counter of the timepiece. If the alarm time is set for minutes, hour and date, the alarm device is operated at the time and on the date for which it has been set. Therefore if it is desirable to have the alarm operate at a predetermined time every day it is necessary to reset the date each day and hence the operation becomes rather complicated and inconvenient. As one means for eliminating this difficulty, it the counted contents of the hour counter is made coincident with the said contents of the date counter it is possible to operate the alarm device every day by the same coincidence signal. However in a multi-alarm device the alarm signal is generated every set time of minutes and hours in every channel whereby it is impossible to generate an alarm signal only on a special day.

SUMMARY OF THE INVENTION

It is accordingly an object of the present invention to provide a plurality of channels with memory circuits by means of which the alarm can be set for a predetermined time on a predetermined date or can be set for a predetermined time without reference to date. When the "no-date" channel is selected the alarm signal is operated at the set time every day. The other channels actuate the alarm only at the set time on the set dates.

A further feature of the invention is that the timepiece is provided with alarm generating circuits for generating a plurality of different alarm sounds so as to provide a different sound for each of the alarm setting channels. For example the signals may be intermittent signals of different lengths or different periods or there may be signals of different frequencies or different amplitudes.

BRIEF DESCRIPTION OF DRAWINGS

The objects, advantages and characteristics of the invention will be more fully understood from the following description of preferred embodiments with reference to the accompanying drawings in which FIG. 1 is a perspective view of an electronic timepiece having an alarm device in accordance with the present invention;

FIG. 3 is a circuit diagram of the time-setting circuit and display controlling circuit of FIG. 2;

FIG. 8 shows wave shapes for explaining the operation of the circuit of FIG. 7;

FIG. 9 is a circuit diagram of a further embodiment of the alarm signal generating circuit;

FIG. 10 shows wave shapes for explaining the operation of the circuit of FIG. 9;

FIG. 11 is a circuit diagram of a further embodiment of the alarm signal generating circuit;

DESCRIPTION OF PREFERRED EMBODIMENTS

Figure 2:
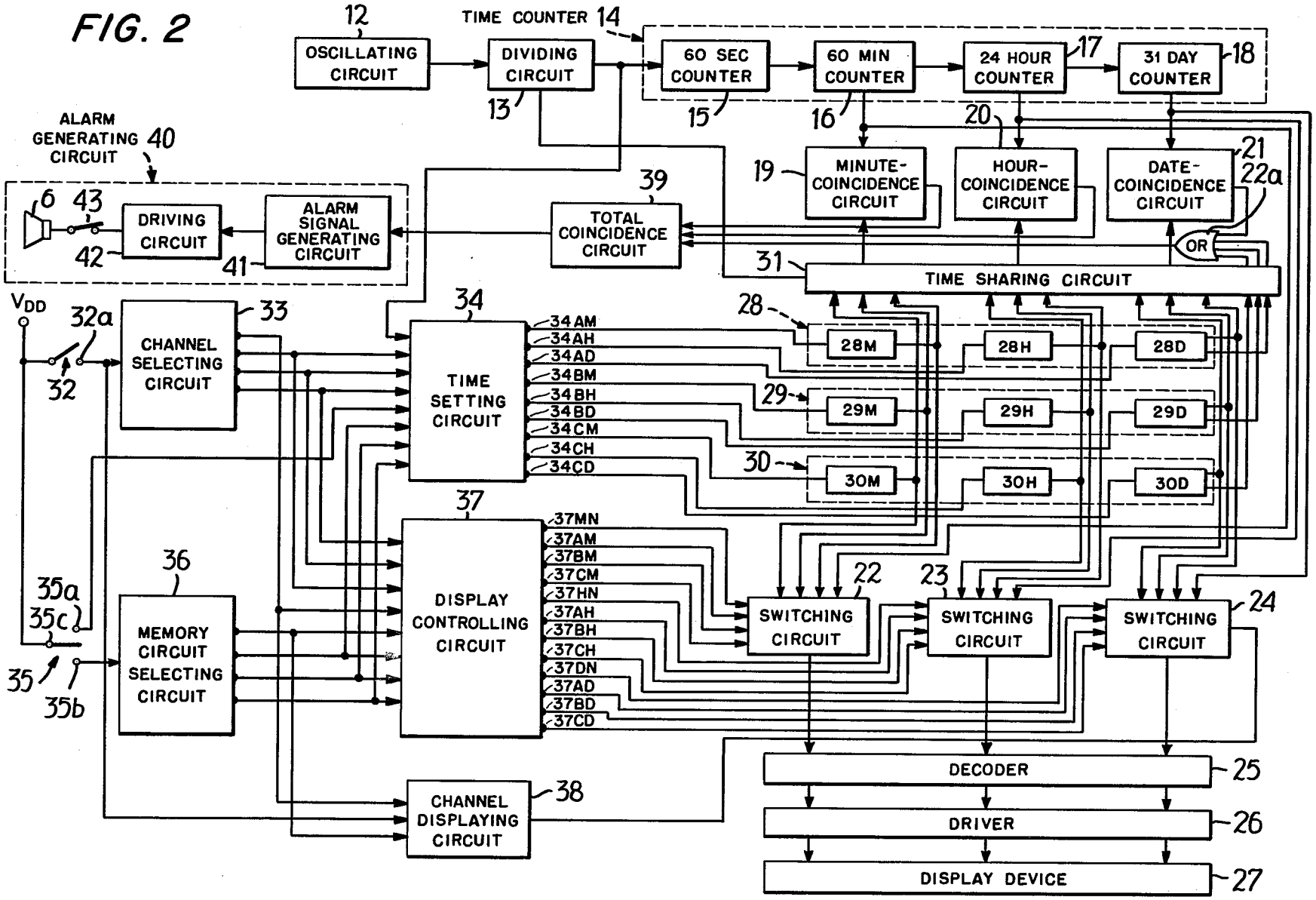
FIG. 2 is a block diagram of the circuitry of the timepiece.

FIG. 1 shows a perspective view of one embodiment of an electronic timepiece in accordance with the invention having alarm device. The timepiece comprises a casing 1 having a window portion 5 for a display panel 2 having display portions 3 and 4. A secondary window portion 7 is provided in the casing for a speaker 6 for generating an alarm sound. A stem member 8 having a shaft 9 is rotatably mounted in said casing. A switch 35 (FIG. 2) is operated by the rotary operation towards the right and left and by the axial operation of the shaft 9. An operational button 10 of a selecting switch 32 (FIG. 2) for selecting the channel of the alarm and an operational button 11 of a stop switch 43 (FIG. 2) for stopping the alarm signal or sound are respectively mounted on said casing 1.

FIG. 2 is a block circuit diagram of a timepiece in accordance with the present invention. An oscillating circuit 12 having a quartz vibrator produces a standard output signal which is divided by a dividing circuit 13 comprising multi-stage dividers, whereby said signal is changed to a 1Hz signal. The standard signal thus provided is counted by the time counter 14 comprising a 60-seconds counter 15, a 60-minutes counter 16, a 24-hour counter 17 and a 31-day counter 18. The counting contents of the BCD-code is respectively generated from said minute, hour and day counters 16, 17 and 18. The output signals from the counters 16, 17 and 18 are respectively applied to a minute-coincidence circuit 19, an hour-coincidence circuit 20 and date-coincidence circuit 21, and are further applied to switching circuits 22, 23 and 24. The switching circuits 22, 23 and 24 usually carry the counting output of the time counter 14 to the decoder 25. The counting contents of the time counter 14 applied to the decoder 25 are displayed in digital style by the display device 27 by the driver 26 after decoding. The display device 27 corresponds to the display panel 2 as illustrated in FIG. 1.

The electronic timepiece having an alarm device in accordance with the present invention has an A-channel 28, a B-channel 29 and a C-channel 30 for setting alarm generating times. The channels 28, 29 and 30 have respectively memory circuits 28M, 29M and 30M for memorizing the alarm setting time of minute-level, memory circuits 28H, 29H and 30H for memorizing the hour-level and memory circuits 28D, 29D and 30D for memorizing the date-level.

The minute memory circuits 28M, 29M and 30M have the same memory capacity as the counting capacity of the minute counter 16, and are adapted to generate the same code signal as the minute counter 16. The hour memory circuits 28H, 29H and 30H have the same memory capacity as the counting capacity of said hour counter 17, and are adapted to generate the same code signal as said hour counter 17. The day memory circuits 28D, 29D and 30D have a larger memory capacity than the counting capacity of the date counter 18, and are able to generate the same code signal as the date counter 18 and also non-set signals without the same code signal. Output signals are generated from said memory circuits 28M - 30D by the BCD-code. The outputs of the memory circuits 28M, 29M and 30M are applied to the switching circuit 22, the outputs of the memory circuits 28H, 29H and 30H are applied to the switching circuit 23, and the outputs of the memory circuits 28D, 29D and 30D are applied to the switching circuit 24. The outputs of the memory circuits of said channels 28, 29 and 30 are fed to a time-sharing circuit 31 employing a dividing signal obtained from a certain stage of the dividing circuit 13, and are cyclically applied to the minute-coincidence circuit 19, the hour-coincidence circuit 20 and the date-coincidence circuit 21, whereby the signals are compared with the counted contents of the counters 16, 17 and 18 by the coincidence circuits 19, 20 and 21.

The minute-coincidence circuit 19 generates a coincidence signal upon detecting coincidence between the counted contents of the minute-counter 16 and the memory contents of any one of the memory circuits 28M, 29M and 30M. The hour-coincidence circuit 20 generates a coincidence signal upon detecting coincidence between the counted contents of the hour counter 17 and the memory contents of any one of the memory circuits 28H, 29H and 30H. Further, the date-coincidence circuit 21 generates a coincidence signal upon detecting coincidence between the counted contents of the date counter 18 and the memory contents of any one of the memory circuits 28D, 29D and 30D. The coincidence signals generated by the minute-coincidence circuit 19 and the hour-coincidence circuit 20 are directly applied to the total coincidence circuit 39. The coincidence signal generated by the date-coincidence circuit 21 is applied to the total coincidence circuit 39 through a four-input OR circuit **22*a***.

The memory capacities of the memory circuits 28D, 29D and 30D are larger than the counting capacity of the date counter 18. When the contents memorized by the memory circuits 28D - 30D become larger than the counting capacity of the date-counter 18, said contents are applied to the OR-circuit **22*a* as a no-date alarm signal through the time-sharing circuit 31. Therefore, when a no-date alarm signal, for which no date time unit is set, is generated by the memory circuits 28D, 29D and 30D, said non-set signal is applied to the total coincidence circuit 39 as a sham coincidence signal through the time-sharing circuit 31 and the OR-circuit 22*a* in spite of there being no output of a coincidence signal from date-coincidence circuit 21. If the date-counter 18 is constructed as a five-bits counter, the code signal employed for displaying the date is set from the logic "1,0,0,0,0" to "1,1,1,1,1,"; the logic "0,0,0,0,0," is not employed. Therefore, the logic 0,0,0,0,0, can be employed as the non-set signal for displaying the non-set alarm condition of the memory circuits 28D, 29D and 30D**.

If the number of bits in the memory counter for constructing the memory circuits 28D, 29D and 30D is larger than the number of the date-counter 18, and further the output of remaining bits becomes logic [1], the signal can be employed as the non-set signal.

A normally open selecting switch 32 is capable of being closed by the operation of pushing the operational button 10 (FIG. 1). One of the contact points of the switch 32 is connected to the power supplying terminal VDD which is kept at the voltage level corresponding to logic [1]. The other contact point **32*a* of the switch 32 is connected to the input terminal of the channel selecting circuit 33 and the channel displaying circuit 38**.

The channel selecting circuit 33 is composed of a four-count type ring counter. The signal of logic [1] sequentially steps the counter to four output terminals 33N, 33A, 33B and 33C whenever a logic [1] signal is applied to the input terminal by ON-OFF operation of the selecting switch 32. The output of the channel selecting circuit 33 is controlled so that the output terminal 33N becomes logic [1] in the usual condition by the operation of the selecting switch 32 or the additional resetting circuit. The outputs from the output terminals 33A, 33B and 33C of the channel selecting circuit 33 are respectively applied to the time setting circuit 34. The outputs from the output terminals 33N, 33A, 33B and 33C are also respectively applied to the display controlling circuit 37. Moreover, the output from the output terminal 33N is applied to the channel displaying circuit 38.

A switch 35 operated by the shaft 9 has a movable contact **35*c* movable between a neutral position and two stationary contacts 35*a* and 35*b*. The movable contact 35*c* is connected to the power supplying terminal VDD. The stationary contact 35*a* is connected to one input terminal of the time setting circuit 34, while the other stationary contact 35*b* is connected to the input terminal of the memory circuit selecting circuit 36. The memory circuit selecting circuit 36 is composed of a four-count type ring counter. When the movable contact 35*c* of the switch 35 is switched to the stationary contact 35*b*, the counter is sequentially stepped and logic [1] is sequentially applied to the output terminals 36N, 36M, 36H and 36D whenever the logic [1] signal is applied to the input terminal. The outputs from the output terminals 36N, 36M, 36H and 36D of the memory circuit selecting circuit 36 are applied to the display controlling circuit 37, the outputs from the output terminals 36M, 36H and 36D are also applied to the time setting circuit 34, and the output from the output terminal 36N is also applied to the channel displaying circuit 38. The output of the memory circuit selecting circuit 36 is controlled so that the output terminal 33N becomes logic [1] in the usual condition by the operation of the selecting switch 32** or the additional resetting circuit.

The 1 Hz signal of the time standard generated by the dividing circuit 13 is applied to the time setting circuit 34. The 1 Hz signal thus appears at the one of the output terminals 34AM, 34AH, 34AD, 34BM, 34BH, 34BD, 34CM, 34CH and 34CD as a time setting signal by switching the movable contact **35*c* of the switch 35 to the stationary contact 35*a* when one of the output terminals 33A, 33B and 33C of the channel selecting circuit 33 is at logic [1] and one of said output terminals 36M, 36H and 36D of the memory circuit selecting circuit 36 is at logic [1]. If the output terminal 33B of the channel selecting circuit 33 is set to logic [1] by the operation of the switch 35, a 1 Hz signal for the time setting signal appears at the output terminal 34BM of the time setting circuit 34 only during said operation period. The 1 Hz time setting signal is thereby applied to the minute memory circuit 29M of the B-channel 29, whereby the contents of said memory circuit 29M is changed. The time setting signal generated from the output terminals 34AM – 34CD of the time setting circuit 34 are applied in like manner to the memory circuits 28M – 30D of said channels 28, 29 and 30**.

The display controlling circuit 37 has 12 output terminals 37MN, 34AM, 37AH, 37AD, 37HN, 37BM, 37BH, 37BD, 37DN, 37CM, 37CH and 37CD. The output signals of the output terminals 37MN – 37CD are applied to the control terminals of the switching circuits 22, 23 and 24. The outputs of the output terminals, 37MN, 37HN and 37DN of the display controlling circuit 37 become logic [1]0 when the output terminal 33N of the channel selecting circuit 33 is logic [1] and the output terminal 36N of the memory circuit selecting circuit 36 is logic [1], whereby another output selecting circuit 36 is logic [1], whereby another output terminal becomes logic [0]. The switching circuits 22, 23 and 24 are controlled for passing the counted contents of the minute, hour and date counters 16, 17 and 18 to the decoder 25 when the outputs of the output terminals 37MN, 37HN and 37DN of said display controlling circuit 37 are logic [1]. Therefore the time corresponding to the counted contents of the hour counter 14 is normally displayed.

If the output terminal 33B of the channel selecting circuit 33 becomes logic [1] and the output terminal 36H of the memory circuit selecting circuit 36 becomes logic [1], whereby only the output terminal 37BH of the display controlling circuit 37 is logic [1], another output terminal becomes logic [0]. In this condition, the switching circuit 23 is controlled for passing the memorized contents of the memory circuit 29H to the decoder 25, and the switching circuits 22 and 24 are controlled for not passing any input signals. Therefore, the memorized contents of the memory circuit 29H being changed by the time setting signal from the time setting circuit 34 is displayed by the display portion 3 of the display device 27.

Accordingly, the particular channel and memory circuit are specified by the operation of the selecting switch 32 and switch 35, thereby enabling the setting of the alarm starting time. It is possible to see the set time by the display of the memorized contents of said memory circuit in which the time is set.

A channel display circuit 38 has two bits and a four-count counter for counting the switching signals being applied by the operation of the selecting switch 32. The counter of the channel displaying circuit 38 is usually reset by the signal of logic [1] being generated from the output terminal 33N of the channel selecting circuit 38. The reset condition of the counter of the channel displaying circuit 38 is released in response to the logic [1] of the output terminal 9 other than output terminal 33N of the channel selecting circuit 33, whereby it is possible to count the number of operations of the selecting switch 32 until the output terminal 33N comes to logic [1]. Said counted contents is displayed by the display portion 4 for displaying the date of the display device 27 instead of the date display by the switching circuit 24 when the output terminal 36N of the memory circuit selecting circuit 36 is logic [1]. If the output terminal 33A of the channel selecting circuit 33 becomes logic [1] by the operation of the selecting switch 32 and A-channel 28 was selected, "1" is displayed by the display portion 4 of said display device 27. "2" is displayed by the display portion 4 of the display device 27 in case of the output terminal 33B becomes logic [1] whereby B-channel 29 was selected. "3" is displayed by the display portion 4 of the display device 27 in case of the output terminal 33C becomes logic [1] whereby C-channel 30 was selected.

The numerals for indicating the channel being selected by the channel selecting circuit 33 is displayed by the display portion 4 indicating the date of the display device 27 by the operation of the channel displaying circuit 38 when the selecting switch 32 is operated for selecting the channel in which the alarm starting time is to be set. The display is terminated in response to the output terminal other than the output terminal 36N of the memory circuit selecting circuit 36 being changed to logic [1] by the operation of the switch 35 for selecting the memory circuit for setting the alarm starting time in the selected channel.

A total coincidence circuit 39 generates a coincidence signal of logic [1] upon detecting all of the logic [1] input signals when the outputs of the minute coincidence circuit 19, the hour coincidence circuit 20 and the date coincidence circuit 21 or the non-set signal passed by the OR-circuit **22*a* are applied. The coincidence signal generated by the total coincidence circuit 39 has the period of 1 minute, being controlled by the period of the coincidence signal being generated by the minute coincidence circuit 19 in the present embodiment. On the other hand, the coincidence signals being generated by the minute coincidence circuit 19, hour coincidence circuit 20 and date coincidence circuit 21 are intermittent waves having a period controlled by the sampling pulse of the time sharing circuit 31, whereby a delay circuit is mounted to said coincidence circuit 39** which generates the continuous coincidence signal of logic [1].

The output of the total coincidence circuit 39 is applied to the alarm generating circuit 40 which is shown as being composed of an alarm signal generating circuit 41 for generating three kinds of alarm signals of corresponding respectively to A-channel 28, B-channel 29 and C-channel 30. A driving circuit 42 for driving the speaker 6 after amplifying the alarm signal, a stopping switch 43 controlled by the pushing operation of the operational button 11 as indicated in FIG. 1 for stopping the start of the alarm sound and for controlling the output of the driving circuit 42 to the speaker 6.

Referring now to the detailed description accompanying FIG. 3 – FIG. 8 of the drawings:

FIG. 3 shows one detailed circuit for indicating the hour setting circuit 34 and the display controlling circuit 37 in FIG. 2, corresponded portions in FIG. 3 to FIG. 7 being designated by the same numerals as in FIG. 2.

The hour setting circuit 34 has two-input type AND-circuits 44M, 44H and 44D each of which has one input terminal connected to the output terminal 33A of the channel selecting circuit 33; two-input type AND-circuits 45M, 45H and 45D each of which has one input terminal connected to the output terminal 33B; two-input type AND-circuits 46M, 46H and 46D each of which has one input terminal connected to the output terminal 33C; a two-input type AND-circuit 48 which has one input terminal connected to the terminal 47 receiving the standard signal from the dividing circuit 13 and the other input terminal connected to the stationary contact 35*a* of the switch 35, and two-input type AND-circuits 49M, 49H and 49D each of which has one input terminal connected to the output of AND-circuit 48. The other input terminal of the AND-circuit 49M is connected to the output terminal 36M of the memory circuit selecting circuit 36. The other input terminal of AND-circuit 49H is connected to the output terminal 36H of the memory circuit selecting circuit 36. The other input terminal of AND-circuit 49D is connected to the output terminal 36D of the memory circuit selecting circuit 36. The output of AND-circuits 44M, 45M and 46M. The output of AND-circuit 49H is applied to the other input terminal of each of AND-circuits 44H, 45H and 46H. The output of AND-circuit 49D is applied to the other input terminal of each of AND-circuits 44D, 45D and 46D.

According to the hour setting circuit 34, when the output terminal 33B of the channel selecting circuit 33 becomes logic [1] by the operation of the selecting switch 32, and when the output terminal 36H of the memory circuit selecting circuit 36 becomes logic [1] by the switching operation of said switch to the stationary contact 35*b*, then switching the switch 35 to the stationary contact 35*a* causes the standard signal from the dividing circuit 13 to appear at the output terminal 34BH as the hour setting signal through AND-circuits 48, 49H and 45H. The output of the output terminal 34BH is applied to the memory circuit 29H memorizing the alarm "hour" setting time of B-channel 29. According to the above noted embodiment, the output terminals 33B and 36H are at logic [1], whereby the operation of the hour setting signal generated from the output terminal 34BH is indicated, then it may be understood that the hour setting signals are selectively generated from said output terminals 34AM – 34CD and are applied to the respective memory circuits 28M – 30D.

The display control circuit 37 (FIG. 3) comprises two-input type AND-circuits 50M, 50H and 50D each of which has one input terminal connected to the output terminal 36N of the memory circuit selecting circuit 36; two-input type AND-circuits 51M, 51H and 51D each of which has one input terminal connected to the output terminal 33*a* of the channel selecting circuit 33, two-input type AND-circuits 52M, 52H and 52D each of which has one input terminal connected to the output terminal 33B of the channel selecting circuit 33; two-input type AND-circuits 53M, 53H and 53D each of which has one input terminal connected to the output terminal 33C of the channel selecting circuit 33, and OR-circuits 54M, 54H and 54D each of which has one input terminal connected to the output terminal 33N of the channel selecting circuit 33. The other input terminal of the OR-circuit 54M is connected to the output terminal 36M of the memory circuit selecting circuit 36. The other input terminal of the OR-circuit 54H is connected to the output terminal 36H of the memory circuit selecting circuit 36. The other input terminal of the OR-circuit 54D is connected to the output terminal 36D of the memory circuit selecting circuit 36. The output of the OR-circuit 54M is applied to the other input terminals of the AND-circuits 50H, 51H, 52H and 53H. The output of the OR-circuit 54D is applied to the other input terminals of the AND-circuits 50D, 51D, 52D and 53D. The outputs of the AND-circuits 50M – 53D become the outputs of the display control circuit 37 whereby the outputs of the AND-circuits 50M – 53D are connected to the output terminals 37MN – 37CD.

The output terminals 37MN, 37HN and 37DN are logic [1] and the other output terminals are the logic [0] in the display control circuit 37 when the output terminal 36N of the memory circuit selecting circuit 36 and the output terminal 33N of the channel selecting circuit 33 are logic [1]. The output terminals 37MN – 37CD are logic [0] when the output terminal 33N of the channel selecting circuit 33 becomes logic [0] in response to the operation of the selecting switch 32 and the output terminal 36N of the memory circuit selecting circuit 33 is logic [1]. In case of the above-noted condition, the channel selected by the channel selecting circuit 33 is displayed by the date display portion 4 of the display device 27. If the output terminal 33B of the channel selecting circuit 33 is logic [1] and B-channel 29 was selected, numeral "2" corresponding to B-channel 29 is displayed by the display portion 4 of the display device 27, whereby the display of time from said display device 27 is interrupted. If the output terminal 36H of the memory circuit selecting circuit 36 is changed to logic [1] by the operation of the switch 35 after the B-channel 29 was selected by the channel selecting circuit 33, the output terminal 37BH of the display controlling circuit 37 becomes logic [1]. The switching circuit 23 passes the memorized contents of the memory circuit 29H to the decoder 25 by operation of the switching circuit 23, whereby the memorized contents of the memory circuit 29H is displayed by the display portion 3 of the display device 27. At this time, the time setting signal being generated by the time setting circuit 34 is applied to the memory circuit 29H, whereby it is possible to set the alarm starting time of "hour" level in the memory circuit 36. In the same manner, the B-channel 29 is selected by the channel selecting circuit 33, if the memory circuits 29M or 29D for setting the alarm starting time of minute or date level are selected by the memory circuit selecting circuit 36, the memorized contents of the memory circuits 29M or 29D are selectively displayed by the display portions 3 or 4 of the display device 27, and the setting of the alarm starting time is attained. Further if the output of the display control circuit 37 is not in the condition in which any one of the memorized contents of the memory circuits 28M – 30D is able to be displayed, the time corresponding to the counting contents of the hour counter 14 and the numeral of the channel according to the output of said channel displaying circuit 38 are not displayed by said display device 27.

Figure 4:
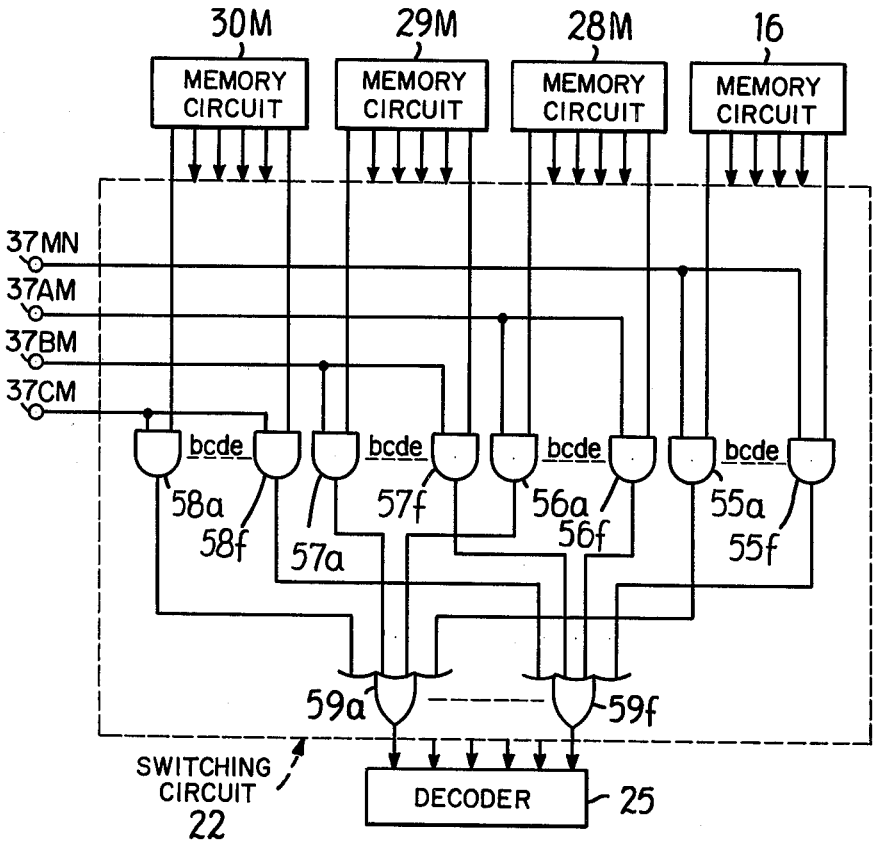
FIG. 4 is a circuit diagram of one switching circuit.

FIG. 4 shows a detailed circuit diagram of the switching circuit 22, the same numerals in FIG. 4 indicating the same circuit portions as in FIGS. 2 and 3. The switching circuit 22 has six two-input type AND-circuits 55*a* – 55*f* in which the outputs of 6-bits-60-counting-minute counter 16 is applied to one input terminal; six two-input type AND-circuits 56*a* – 56*f* in which 6-bits signals generated from the memory circuit 28M of A-channel 28 are applied to one input terminal; six two-input type AND-circuits 57*a* – 57*f* in which 6-bits signals generated from the memory circuit 29M of B-channel 29 are applied to one input terminal; six two-input type AND-circuits 58*a* – 58*f* in which 6-bits signals generated from the memory circuit 30M of C-channel 30 are applied to one input terminal; a four input type OR-circuit 59*a* to which the outputs of the AND-circuits 55*a*, 56*a*, 57*a* and 58*a* are applied, four OR-circuits 59*b* – 59*e* to which the outputs of AND-circuits 55*b* – 58*b*, 55*c* – 58*c*, 55*d* – 58*d* and 55*e* – 58*e* are respectively applied, and a four input type OR-circuit 59*f* to which the outputs of AND-circuits 55*f*, 56*f*, 57*f* and 58*f* are applied. The output from the output terminal 37MN of the display controlling circuit 37 is applied to the other input terminal of each of the AND-circuits 55*a* - 55*f*; the output from the output terminal 37AM of the display controlling circuit 37 is applied to the other input terminal of each of the AND-circuits 56*a* - 56*f*; the output from the output terminal 37BM of the display controlling circuit 37 is applied to the other input terminal of each of the AND-circuits 57*a* - 57*f*, and the output from the output terminal CM of the display controlling circuit 37 is applied to the other input terminal of each of the AND-circuits 58*a*-58*f*. The output of the switching circuit 22 is generated from the OR-circuits 59*a*-59*f* and is applied to the decoder 25.

The switching circuit 22 passes the output of the minute counter 16 to the decoder 25 through AND-circuits 55*a*-55*f* and OR-circuits 59*a*-59*f* when the output terminal 37MN of the display controlling circuit 37 is logic [1]. The memorized contents of the memory circuit 29M is passed to the decoder 25 through AND-circuits 57*a*-57*f* and OR-circuits 59*a*-57*f* when the memory circuit 29M of B-channel is selected, whereby the output terminal 37 BM of the display controlling circuit 37 becomes logic [1].

FIG. 4 shows one embodiment of the switching circuit 22. The switching circuit 23 is of the same construction as said switching circuit 22 and therefore its detailed construction is not shown. However the output of the hour counter 17 in the switching circuit 23 is a five-bits signal whereby the required number of AND and OR-circuits is reduced.

Figure 5:
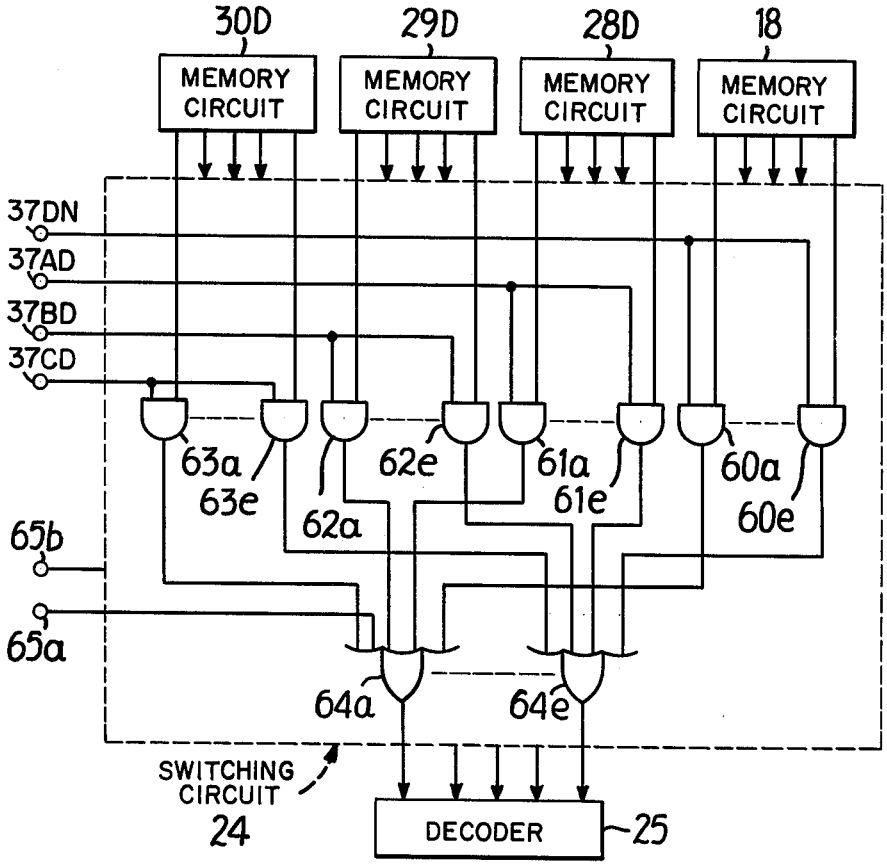
FIG. 5 is a circuit diagram of another switching circuit.

FIG. 5 shows one embodiment of the switching circuit 24, the same numerals in FIG. 2 and 3 being shown in FIG. 5. The switching circuit 24 is of a construction similar to that of the switching circuit 22, and is composed of AND-circuits 60*a*-60*e* to which the outputs of five bits of the date-counter 18 are applied, AND-circuits 61*a*-61*e* to which the outputs of the memory circuit 28D of the A-channel are applied, AND-circuits 62*a*-62*e* to which the outputs of the memory circuit 29D of the B-channel 29 are applied, AND-circuits 63*a*-63*e* to which the outputs of the memory circuit 30D of C-channel 30 are applied, OR-circuit 64*a* to which the outputs of AND-circuits 60*a*-63*a* are applied, OR-circuit 64*b* to which the outputs of AND-circuits 60*b*-63*b* are applied, OR-circuit 64*c* to which the outputs of AND-circuits 60*c*-63*c* are applied, OR-circuit 64*d* to which the outputs of AND-circuits 60*d*-63*d* are applied, and OR-circuit 64*e* to which the outputs of AND-circuits 60*e*-63*e* are applied. The output from the output terminal 37DN of the display controlling circuit 37 is applied to the second inputs of AND-circuits 60*a*-60*e*, the output from the output terminal AD of the display controlling circuit 37 is applied to the second inputs of AND-circuits 61*a*-61*e*, the output from the output terminal 37BD of the display controlling circuit 37 is applied to the second inputs of AND-circuits 62*a*-62*e*, and the output from the output terminal 37CD of the display controlling circuit 37 is applied to the second inputs of AND-circuits 63*a*-63*e*. The output of the channel displaying circuit 38 being applied to the terminal 65*a* is applied to the OR-circuit 64*a* to which the outputs of AND-circuits 60*a*, 61*a*, 62*a* and 63*a* are also applied. Furthermore, the output of th channel displaying circuit 38 being applied to the terminal 65*b* is applied to OR-circuit 64*b* (not shown) to which the outputs of AND-circuits 60*b*, 61*b*, 62*b* and 63*b* are also applied).

The output of the switching circuit 24 is generated from OR-circuits 64*a*-64*e*, and then applied to the decoder 25. The counting output of the date-counter 18 is applied to the decoder 25 through AND-circuits 60*a*-60*e* and OR-circuits 64*a*-64*e* when the output terminal DN of the display controlling circuit 37 is logic [1]. The memorized contents of the memory circuit 29D of B-channel 29 is applied to the decoder 25 through AND-circuits 62*a*-62*e* and OR-circuits 64*a*-64*e* when the output terminal 37BD of said display controlling circuit 37 is logic [1]. Furthermore, when the output terminals 37MN-37CD of the display controlling circuit 37 become logic [0], the channel displaying signal selected by the channel selecting circuit 33 is applied to the decoder 25 through OR-circuits 64*a* and 64*b*.

Figure 6:
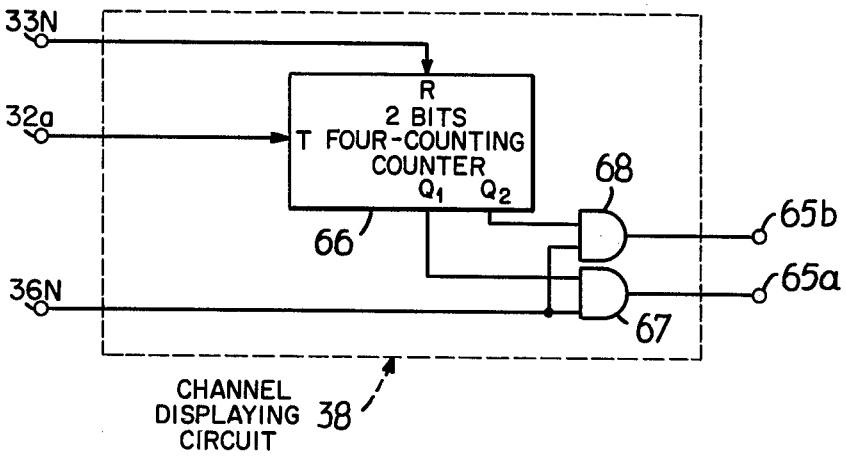
FIG. 6 is a circuit diagram of a channel displaying circuit.

FIG. 6 shows one embodiment of the channel displaying circuit 38, the same numerals as in FIGS. 2, 3 and 5 being employed to designate the same portions in FIG. 6. The channel displaying circuit 38 is composed of a 2-bits four-counting counter 66 in which the switching signal in response to the operation of the selecting switch 32 is applied to the input terminal T; AND-circuit 67 in which the output of the output terminal $Q_1$ of the counter 66 is applied to the one input terminal and the output of the output terminal 36N of the memory circuit selecting circuit 36 is applied to the other input terminal, and AND-circuit 68 in which the output of output terminal $Q_2$ of the counter 66 is applied to the one input terminal and the output of the output terminal 36N of the memory circuit selecting circuit 36 is applied to the other input terminal. The output from the output terminal 33N of the channel selecting circuit 33 is applied to the resetting terminal "R" of the counter 66. The logic in output terminals $Q_1$ and $Q_2$ becomes [0,0] according to the logic [1] applied to resetting terminal 19 and the reset condition of the counter 66. The ring-counter of the channel selecting circuit 33 is operated by the starting point of the input pulse; the counter 66 is operated by the ending point of said input pulse. If the selecting switch 32 is operated once, the logic of the output terminal 33 of the channel selecting circuit 33 is changed from [1] to [0] in the closed condition of the switch, whereby the reset of the counter 66 is released, and the output terminal $Q_1$ of the counter 66 becomes logic [1] at the opened condition of the selecting switch 32, whereby the output of the counter 66 becomes logic [1, 0]. The output of AND-circuit 67 becomes logic [1] when the output terminal 36N of the memory circuit selecting circuit 36 is logic [1]; the output of the AND-circuit 67 is applied to the terminal 65*a*; the output of the AND-circuit 68 becomes logic [0] and is applied to the terminal 65*b*. The output of the OR-circuit 64 becomes logic [1] by the input of the signal of logic [1] to said terminal 65*a*, the numeral "1" indicating the selected A-channel 28 is displayed by the display portion 4 in which the date of the display device 27 is displayed. If the selecting switch 32 is operated twice from the normal condition, the output of the counter 66 becomes logic [0,1], whereby the signal of logic [1] is applied to the OR-circuit 64*b* of the switching circuit 24 through the AND-circuit 68 and terminal 65*b*, the numeral "2" indicating the selected B-channel 29 is displayed by the display portion 4 of the display device 27. If the selecting switch 32 is operated three times from the normal condition, the output of the counter 66 becomes logic

[1,1], and the display of the selected channel by the display device 27 ceases.

Figure 7:
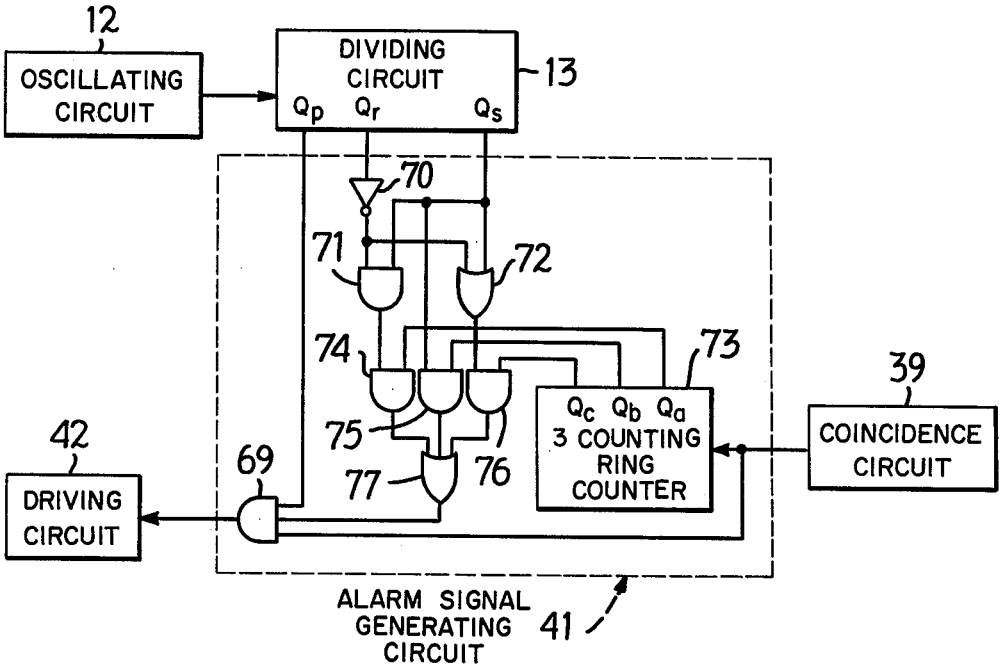
FIG. 7 is a circuit diagram of an alarm signal generating circuit.

FIG. 7 shows one embodiment of the alarm signal generating circuit 41 of the alarm generating circuit 40, the same numerals as in FIG. 2 being employed to designate the same portions in FIG. 7. The alarm signal generating circuit 41 produces three kinds of alarm signals having different lengths, according to each of the channels for setting the time of alarm generating time, derived from the dividing signals from three dividing steps $Q_p$, $Q_r$ and $Q_s$ in the dividing circuit 13. The oscillating signal of the oscillating circuit 12 is 32,768 Hz, whereby the dividing steps $Q_p$, the dividing signal of 4 Hz is generated from 13 dividing steps $Q_4$, and the dividing signal of 2Hz is generated from 14 dividing steps $Q_s$. The output of dividing step $Q_p$ is applied to one input terminal of a 3-input type AND-circuit 69, the output of dividing steps $Q_r$ is applied to one input terminal of a 2-input type AND-circuit 71 and a 2 input type OR-circuit 72, and the output of the dividing step $Q_s$ is applied to the other input terminals of AND-circuit 71 and OR-circuit 72 and to one input terminal of 2-input type AND-circuit 75. The output of AND-circuit 71 is applied to one input terminal of 2-input type AND-circuit 74, and the output of OR-circuit 72 is applied to one input terminal of 2-input type AND-circuit 76. A 3-counting ring-counter 73 counts the coincidence signals being generated by the coincidence circuit 39. The output from the output terminal $Q_a$ of the ring counter 73 is applied to the other input terminal of AND-circuit 74, the output from the output terminal $Q_b$ is applied to the other input terminal of AND-circuit 75, and the output from the output terminal $Q_c$ is applied to the other input terminal of AND-circuit 76. The outputs of AND-circuits 74, 75 and 76 are applied to the input terminal of a 3-input type OR-circuit 77. The output of OR-circuit 77 is applied to AND-circuit 69 together with the outputs of the dividing step $Q_p$ and of coincidence circuit 39. The output of the alarm signal generating circuit 41 is obtained from AND-circuit 69 and is applied to the driving circuit 42.

The operation of the alarm signal generating circuit will now be explained with reference to FIG. 8:

In FIG. 8, $J_r$ is the output wave-shape of dividing step $Q_r$, $J_s$ is the output wave-shape of dividing step $Q_s$, $J_a$ is the output wave-shape of AND-circuit 74 when the state of the output terminal $Q_a$ of the ring-counter 73 is logic [1] $J_b$ is the output wave-shape of AND-circuit 74 when the state of the output terminal $Q_a$ of the ring-counter 73 is logic [1]. $J_b$ is the output wave-shape of AND-circuit 75 when the state of the output terminal $Q_b$ of the ring-counter 73 is logic [1], and $J_c$ is the output wave-shape of AND-circuit 76 when the state of the output terminal $Q_b$ of the ring-counter 73 is logic [1], and $J_c$ is the output wave-shape of AND-circuit 76 when the state of the output terminal $Q_c$ of the ring-counter 73 is logic [1]. $J_p$ is the output wave-shape of the dividing step $Q_p$. If the contents of hour counter 14 is coincident with the contents of alarm starting time set in A-channel 28, the coincidence signal of logic [1] is generated from the coincidence circuit 39 and the output terminal $Q_a$ of the ring-counter 73 becomes logic [1], whereby a signal of wave shape $J_a$ having a period of $\frac{1}{2}$ sec. and duty ratio $\frac{1}{4}$ is generated and is applied to AND-circuit 69 through OR-circuit 77. The output of dividing step $Q_p$ of wave-shape $J_p$ is applied to one input terminal of the AND-circuit 69 and the coincidence signal is applied to the remaining input terminal whereby the intermittent signal of 1024 Hz of wave shape JA having a length of $\frac{1}{8}$ sec. and interval of $\frac{3}{8}$ sec. is generated from AND-circuit 69. If the contents of B-channel 29, and the output terminal $Q_b$ of the ring-counter 73 becomes logic [1], and intermittent signal of 1024 Hz of wave shape JB having a length of $\frac{1}{4}$ sec. and an interval of $\frac{3}{8}$ sec. is generated from AND-circuit 69. If the contents of hour counter 14 coincides with the contents of C-channel 30, and the output terminal $Q_c$ of the ring-counter 73 becomes logic [1], an intermittent signal of 1024 Hz of wave shape JC having a length of $\frac{3}{8}$ sec. and an interval of $\frac{1}{8}$ sec. is generated from AND circuit 69. The output of AND-circuit 69 is applied to the speaker 6 by the driving circuit 42, whereby three kinds of alarm signal are generated in response to each of the channels respectively when the time which has been set in channels 28, 29 and 30 occurs. According to other embodiments of the alarm signal generating circuit 41, as hereinafter described, it is possible to apply other signals to the speaker 6. For example, the circuit generating the alarm signal may provide sounds of different loudness, tones and frequencies in response to the respective channels.

Thus, it is possible to generate an alarm at preset times by the presetting of A, B and C-channels 28, 29 and 30. If the alarm is to be operated by A-channel 28 everyday, it is necessary to set the memorized contents of the memory circuit 28D for generating a non-set signal from said memory circuit 28D. If the output logic of the memory circuit 28 indicating a non-set signal is selected as [0,0,0,0,0], the numeral [0] is displayed by the display portion 4 of the display device 27, whereby the non-set condition of alarm is displayed. The non-set signal of logic [1] is intermittently applied to OR-circuit **21*a* by the time-sharing circuit 31 and the input signal of the total coinciding circuit 39 becomes logic [1] whereby the alarm signal is generated whenever the alarm setting contents of minutes and hours of A-channel 28 is coincident with the counted contents of the hour counter 17 and minute counter 16. However, in the case of the outputs of the memory circuits of B-channel 29 and C-channel 30 which pass the time sharing circuit 31, the non-set signal of the memory circuit 28D does not pass the time sharing circuit 31, whereby the alarm is not generated by the B and C-channels 29 and 30 without the coincidence between minute, hour and date of the channels 29 and 30 and the counted contents of the minute, hour and date counters 16, 17 and 18**.

Other detailed embodiments of the present invention are illustrated in FIGS. 9 to 14 and are explained as follows:

FIG. 9 shows another detailed embodiment of the alarm signal generating circuit 41, the same numerals as are used in FIG. 2 identifying the same portions of FIG. 9. This alarm circuit can generate three kinds of alarm sounds, using dividing signals generated from four dividing stages $Qn$, $Qn+1$, $Qn+2$ and $Qt$ of the dividing circuit 13. Qn generates 1024Hz, $Qn+1$ and $Qn+2$ generate 512Hz respectively and $Qt$ generates 2HZ. Said signals of $Qn$ $Qn+1$, $Qn+2$ are applied to one input terminal of each of four-input type AND circuits 78, 79 and 80, while the outpt of Qt is applied to one input terminal of each of AND-circuits 78, 79 and 80. A three-counting type ring-counter 81 receives the coincidence signal from total coincidence circuit 39. The outputs of AND-circuits 78, 79 and 80 are applied to a three-input type OR-circuit **77*a* and the output of OR-circuit 77***a* is applied to the driving circuit 42. In FIG. 10, curve K*t* shows the output wave shape of Q*t*. K*n*, K*n*+1 and K*n*+2 show the output wave shapes of dividing steps of Q*n*, Q*n*+1 and Q*n*+2. The signal of 256 Hz having a ¼ sec. term is generated from AND-circuit 80 as indicated in wave shape K*d*; the signal of 512Hz having a ¼ sec. term of wave shape K*e* is generated from AND-circuit 79, and the signal of 1024Hz having a ¼ sec. term of wave shape K*f* is generated from AND-circuit 78, whereby three kinds of sounds of different frequency are generated.

FIG. 11 shows a further detailed embodiment of the alarm signal generating circuit 41. This embodiment aims to generate three kinds of alarm sounds of different loudness and has three AND-circuits 82, 83 and 84 to which the outputs Q*x*, Q*y* and Q*z* of dividing circuit 13 are respectively applied. The dividing step Q*x* generates the dividing signal of 100Hz-several KHz; the fourth dividing step generates a 2048Hz signal. The dividing step Q*y* generates a 512Hz signal and the dividing step Q*z* generates a lower frequency of several 10Hz.

Figure 12:
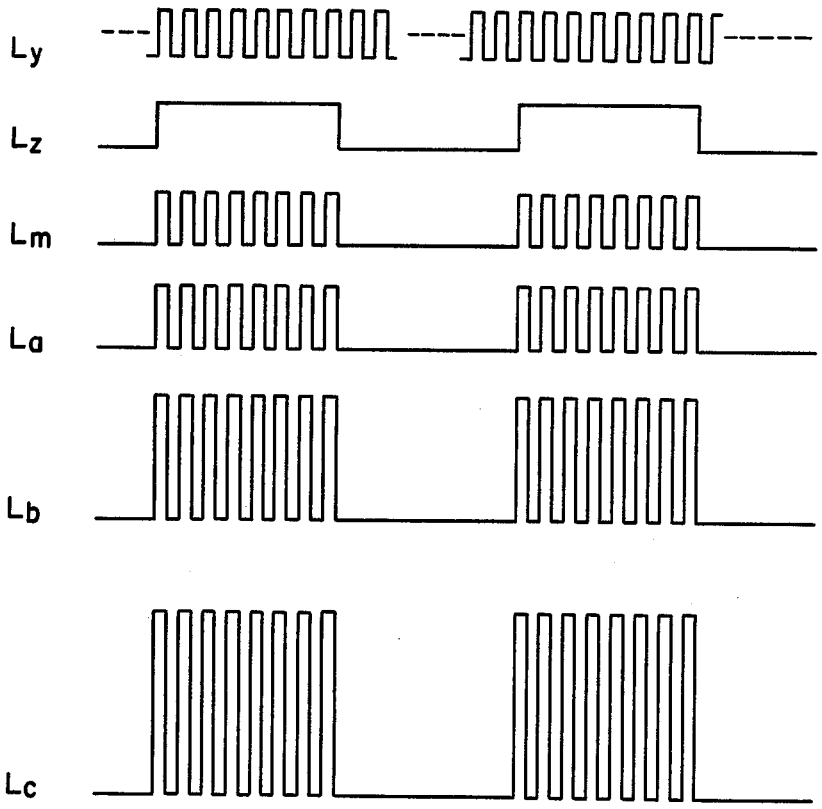
FIG. 12 shows wave shapes for explaining the operation of the circuit of FIG. 11.

A voltage booster circuit 88 elevates the voltage E to *n*E volts and has a dividing voltage circuit. The voltage E*a* of ⅓ *n*E is generated from the output terminal 88*a*, the voltage E*b* of ⅔ *n*E is generated from the output terminal 88*b*, the voltage E*c* equal to *n*E is generated from the output terminal 88*c*, whereby three kinds of sounds of different amplitude or loudness are obtained. These signals are applied to the transmission gates 89*a*, 89*b* and 89*c*, the output of which is applied to the speaker through the transistor 86. In FIG. 12, L*y* is the wave shape of dividing step Q*y*, L*z* is the wave shape of dividing step Q*z*, L*m* is the wave shape of AND-circuit 84 and L*a*, L*b* and L*c* are the wave shapes of the booster terminals 88*a*, 88*b* and 88*c* respectively.

Figure 14:
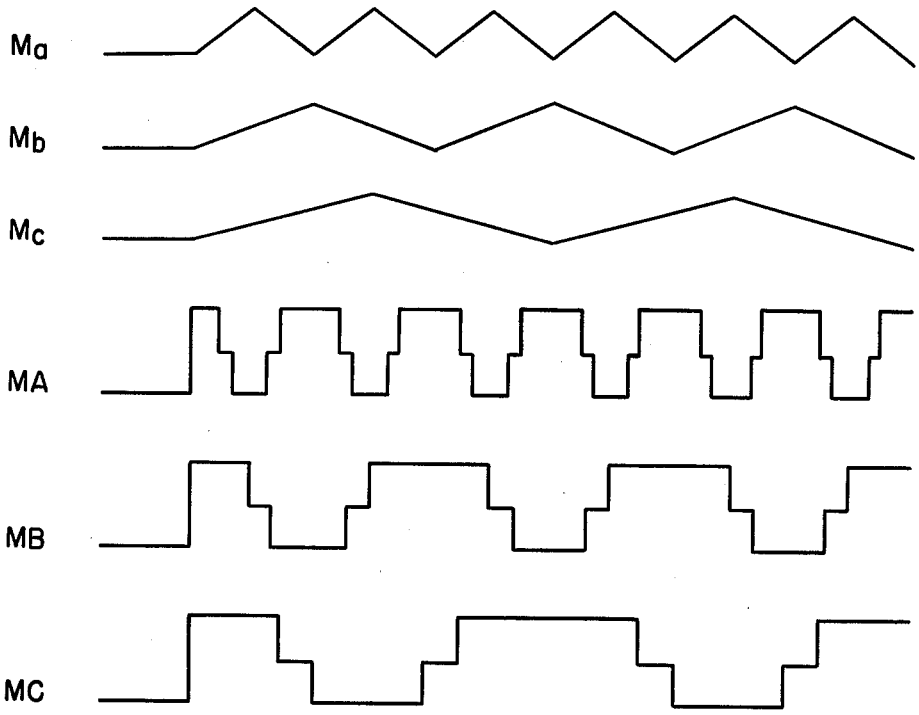
FIG. 14 shows wave shapes for explaining the operation of the circuit of FIG. 13.
Figure 13:
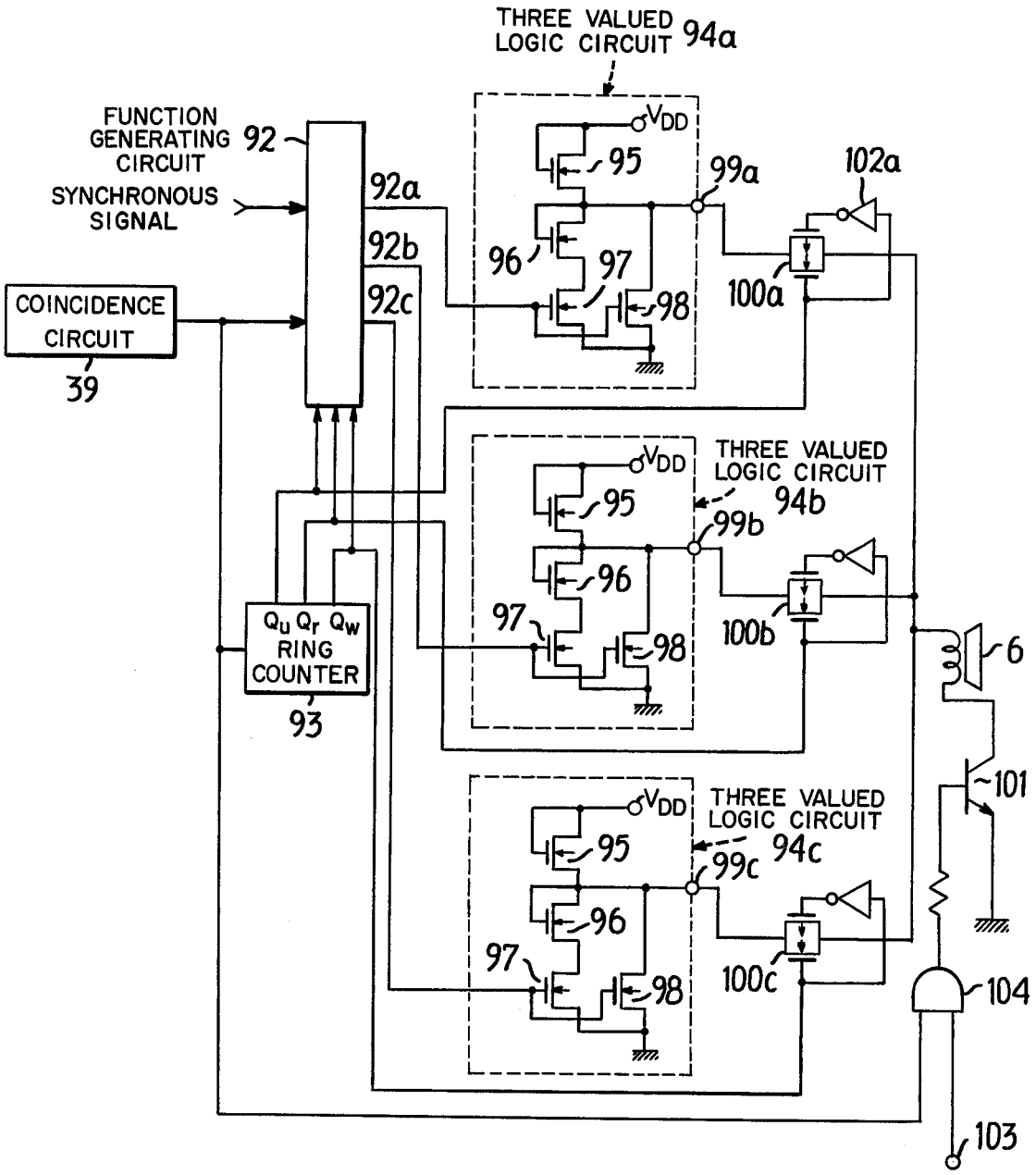
FIG. 13 is a circuit diagram of a circuit for generating different tones.

FIG. 13 shows another detailed embodiment of the present invention. This embodiment aims to generate different tones. A function generating circuit 92 has three input terminals connected respectively to the output terminals Q*u*, Q*v* and Q*w* of a ring-counter 93, and generates three kinds of triangular waves M*a*, M*b* and M*c* of different period as seen in FIG. 14. Said waves are generated from the output terminals 92*a*, 92*b* and 92*c*, and are applied to the three valued logic circuits 94*a*, 94*b* and 94*c* each composed of four MOS transistors 95, 96, 97 and 98.

MOS-transistors 97 and 98 of the three valued logic circuits 94*a*, 94*b* and 94*c* become to OFF-condition in case the input voltage V*i* is smaller than the threshold voltage V*tc* and V*td*, whereby the voltage VD is generated from the output terminals 99*a*, 99*b* and 99*c*. MOS-transistor 97 is ON and MOS-transistor 98 is OFF in case the input voltage V*i* is higher than the threshold voltage D*tc* and lower than the voltage V*td*, whereby a voltage of ½ VD is generated from the output terminals 99*a*, 99*b* and 99*c*. MOS-transistors 97 and 98 are ON in case the input voltage V*i* is higher than the threshold voltage V*tc* and V*td*, whereby O-voltage is generated from the output terminals 99*a*, 99*b* and 99*c*. Therefore, the signal of triangular wave MA (FIG. 14) having three leveled signals is generated from the three valued logic circuit 94*a*, the signal of wave shape MB is generated from the three valued logic circuit 94*b*, and the signal of wave shape MC is generated from said three valued logic circuit 94*c*.

The outputs of said circuits 94*a*, 94*b* and 94*c* are respectively applied to the transmission gates 100*a*, 100*b* and 100*c* and the outputs of the transmission gates 100*a*–100*c* are through the speaker 6 to collector of a transistor 101. The base of the transistor is connected to the output of an AND circuit 104, one input of which is connected to the output of the total coincidence circuit 39 while the other is connected to a voltage terminal 103. The output from output terminal Q*u* of the ring-counter 93 is applied to one control terminal of said transmission gate 100*a*, and is applied to the other control terminal via the inverter 102*a*. The output of the output terminal Q*r* of the ring counter 93 is applied in like manner to the control terminals of the transmission gate 100*b*. The output of output terminal Q*w* of the ring-counter 93 is similarly applied to control terminals of said transmission gate 100*c*. The alarm sound of wave shape MA is operated when said transmission gate 100*a* is ON-position, the alarm sound of wave shape MB is operated when said transmission gate 100*b* is ON-position, the alarm sound of wave shape MC is operated when said transmission gate 100*c* is ON-position. Therefore, it is possible to operate three different alarm sounds corresponding to the several channels.

The invention is not limited to present embodiments as it is possible to apply many other modifications and improvements. For example, more than or less than three channels can be set. It is possible to enlarge the memory capacity of the memory circuit for setting the date of a plurality of channels for setting alarm time so as to be greater than the counting capacity of the date-counter, whereby it is possible to change the date set condition of the alarm to non-set condition. Further, the non-set signal is applied to the coincidence circuit as the coincident condition between the counted contents of date-counter and the memory contents of the memory circuit, whereby it is possible to generate the alarm when the set time of a certain channel occurs.

What I claim is:

1. An electronic timepiece having an alarm device comprising in combination: time counters comprising minute, hour and date counters: at least one channel having memory circuits corresponding respectively to said counters for setting alarm starting time: a coincidence circuit for detecting a coincidence between the output contents of said counters and the output contents of said memory circuits, an alarm generating circuit for generating an alarm signal in response to the output of said coincidence circuit: said memory circuit in said channel corresponding to said date counter having a memorizing capacity exceeding the counting capacity of said date counter, means for generating a non-set signal without a code signal corresponding to the code signal generated by said date counter, and means for applying said non-set signal to said coincidence circuit instead of the coincidence signal between said date counter and the output contents of said memory circuit, whereby said alarm can selectively be set for a time and date or only for a time.

2. An electronic timepiece having an alarm device comprising in combination: time counters comprising minute, hour and date counters: a plurality of channels having memory circuits corresponding respectively to said counters for setting alarm starting times, coincidence circuit means for detecting a coincidence between the output contents of said counters and the output contents of said memory circuits, an alarm generating circuit for generating an alarm signal in response to the output of said coincidence circuit means: said memory circuit in said channel corresponding to said date counter having a memorizing capacity exceeding the counting capacity of said date counter, means for generating a non-set signal without a code signal corresponding to the code signal generated by said date counter, and means for applying said non-set signal to said coincidence circuit means instead of the coincidence signal between said date counter and the output contents of said memory circuit.

3. An electronic timepiece as claimed in claim 2, in which said alarm generating circuit comprises means for generating a plurality of different alarm sounds and means for coordinating said different sound generating means with said channels to provide a different alarm sound for each channel.

4. An electronic timepiece having an alarm device comprising: time counting means for counting a time standard: an alarm device for generating alarm sounds: a plurality of channels for manually setting a plurality of different alarm times, alarm generating circuit means for activating said alarm device to generate a plurality of different alarm sounds, coincidence circuit means for activating said alarm generating circuit means when time counted by said time counting means coincides with the time set by any of said alarm time setting channels, and means coordinating said alarm generating circuit means with said alarm time setting channels to provide a different alarm sound for each of said channels respectively.

5. An electronic timepiece as claimed in claim 4, in which said alarm generating circuit means comprises means for generating signals to produce alarm sounds of different frequencies.

6. An electronic timepiece as claimed in claim 4, in which said alarm generating circuit means comprises means for generating signals to produce alarm sounds of different loudness.

7. An electronic timepiece as claimed in claim 4, in which said alarm generating circuit means comprises means for generating signals to produce alarm sounds of different tones.

* * * * *